US009964373B2

(12) United States Patent
Mills

(10) Patent No.: US 9,964,373 B2
(45) Date of Patent: May 8, 2018

(54) MAGAZINE LOADING DEVICE AND METHOD FOR LOADING A MAGAZINE

(71) Applicant: A.F.I. Design Co., LLC, Cicero, NY (US)

(72) Inventor: Eric J. Mills, Cicero, NY (US)

(73) Assignee: A.F.I. DESIGN CO., LLC, Cicero, NY (US)

( * ) Notice: Subject to any disclaimer, the term of this patent is extended or adjusted under 35 U.S.C. 154(b) by 0 days. days.

(21) Appl. No.: 15/371,610

(22) Filed: Dec. 7, 2016

(65) Prior Publication Data

US 2017/0211902 A1 Jul. 27, 2017

(51) Int. Cl.
*F41A 9/82* (2006.01)
*F41A 9/83* (2006.01)
*F41A 9/84* (2006.01)

(52) U.S. Cl.
CPC .. *F41A 9/83* (2013.01); *F41A 9/84* (2013.01)

(58) Field of Classification Search
CPC ..... F41A 9/82; F41A 9/83; F41A 9/84
See application file for complete search history.

(56) References Cited

U.S. PATENT DOCUMENTS 447,577 A 3/1891 Milovanovitch-Koka
578,931 A 3/1897 Johnson
600,367 A 3/1898 Brewer
2,783,570 A 3/1957 Kunz
2,834,137 A * 5/1958 Kunz ..... F41A 9/83 42/87
2,856,720 A 10/1958 Kunz
2,887,811 A 5/1959 Johnson
3,789,531 A * 2/1974 Kersten ..... F42B 39/00 206/3
4,538,371 A * 9/1985 Howard ..... F41A 9/83 42/87
6,286,243 B1 9/2001 Hinton
6,754,987 B1 * 6/2004 Cheng ..... F41A 9/83 42/87
9,239,198 B2 1/2016 McPhee
9,273,917 B1 3/2016 Buckner
(Continued)

FOREIGN PATENT DOCUMENTS

GB 2050582 A * 1/1981 ..... F41A 9/83
GB 2487801 8/2012
GB 2487801 B * 2/2013 ..... F41A 9/83

*Primary Examiner* — Gabriel Klein
(74) *Attorney, Agent, or Firm* — Wenderoth, Lind & Ponack, L.L.P.

(57) ABSTRACT

A magazine loader having a base member and support members, the base member being configured to sit upon the magazine fixed to a rifle, the base member having a first end wall, a second end wall, and a pair of sidewalls defining a rectangular shape, wherein the first end wall has an opening that allows the base member to sit upon the magazine fixed to a rifle, wherein an entirety of the second end wall and an entirety of each of the sidewalls are coplanar, wherein the support members have a first support member and a second support member each extending from a top surface of the base member, wherein the first support member has a plurality of support lips that forms a channel that is capable of accepting a retainer strip of cartridges, and wherein the second support member receives a bullet end of a cartridge, and related methods.

9 Claims, 5 Drawing Sheets

(56) References Cited

U.S. PATENT DOCUMENTS

| | | | | |
|---|---|---|---|---|
| 2013/0232843 | A1 | 9/2013 | Bajuelo | |
| 2014/0311008 | A1* | 10/2014 | McPhee | F41A 9/83 42/87 |
| 2015/0377573 | A1* | 12/2015 | Niccum | F41A 9/83 42/87 |

* cited by examiner

MAGAZINE LOADING DEVICE AND METHOD FOR LOADING A MAGAZINE

TECHNICAL FIELD

The present application is related to magazine loading devices and methods for loading a magazine. Specifically, the present application relates to magazine loading devices that can be conveniently used with a rifle, such as an AR-10® or AR-15® style rifle, that has a magazine fixed thereto. The present application also relates to a method of loading a magazine that is fixed to a rifle, such as an AR-10® or AR-15® style rifle.

BACKGROUND

The New York Secure Ammunition and Firearms Enforcement Act of 2013 ("NYSAFE Act"), banned the sale of assault rifles in New York State, inter alia, and similar laws have been introduced nationwide. The NYSAFE Act defines the term "assault rifle" to include semiautomatic rifles that have the ability to accept a detachable magazine, and have at least one of the following military characteristics: a) folding or telescoping stock; b) protruding pistol grip; c) thumbhole stock; d) second handgrip or protruding grip that can be held by a non-shooting hand; e) bayonet mount; f) flash suppressor; g) muzzle brake; h) muzzle compensator; i) a threaded barrel designed to accommodate the above; and/or j) grenade launcher. However, semiautomatic rifles having a fixed magazine are not specifically included in the NYSAFE Act. New York Solicitor General Barbara Underwood has indicated that a primary goal of the NYSAFE Act is to address the number of rounds that can be fired without a pause to reload, which can limit the ability of individuals to perpetrate mass shootings. Indeed, the New York Solicitor General has indicated that, if a magazine is fixed to the semiautomatic rifle, the semiautomatic rifle can have all the features that the user desires. Thus, the sale and use of semiautomatic rifles having a fixed magazine appears to remain legal in New York State and beyond.

The act of fixing a magazine to a rifle can be accomplished via a number of known and commercially available methods, or by any means which would fix the magazine to comply with local and state laws. Such an act results in the user having to load the magazine while it is attached to the rifle, rather than replacing the empty magazine with a separate, fully loaded magazine. The act of reloading a magazine while the magazine is attached to the rifle is significantly slower than replacing the empty magazine with a separate, fully loaded magazine because each cartridge must be introduced into the magazine individually by hand. In contrast, loading a magazine that is detached from a rifle can be accomplished with a commercially available magazine loader, such as the loader discussed in U.S. Pat. No. 4,538,371. The slow, manual reloading of the magazine accomplishes the goal of making semiautomatic rifles more difficult to reload, which can assist in preventing mass shootings. However, the slow, manual reloading of the magazine also affects the ability of law-abiding gun owners to use rifles with relative ease.

Fixing a magazine to a rifle causes a number of problems. For instance, to load a magazine that is fixed to an AR-10® and/or AR-15® style rifle, a pin is pulled that allows the upper receiver of the rifle body to pivot and expose the top of the empty, fixed magazine. In such an instance, the empty, fixed magazine protrudes from the lower receiver of the rifle body by approximately ½ an inch. Commercially available magazine loaders are not designed to accommodate such a fixed magazine because commercially available magazine loaders are typically built so that the magazine slides approximately 1 inch into the loader. Thus, commercially available magazine loaders do not sit properly on a rifle with a fixed magazine, which makes the use of commercially available magazine loaders difficult with rifles having fixed magazines.

Also, commercially available magazine loaders do not leave space for the internal mechanisms of the rifle that abut the exposed, fixed magazine. For instance, the bolt catch/release mechanism interferes with the ability of commercially available magazine loaders to be used with magazines fixed to rifles. Therefore, commercially available magazine loaders do not sit properly on a rifle with a fixed magazine because these mechanisms do not allow the magazine loader to sit directly upon the lower receiver of the rifle body.

A number of commercially available magazine loaders are known.

U.K. Patent Application No. GB 2487801 discloses devices used to load multiple rounds of ammunition into a magazine in one operation. The magazine loading device of GB 2487801 generally provides for loading thirty rounds of ammunition into a magazine, wherein the device comprises a body portion having a first cavity capable of receiving thirty rounds of ammunition arranged side by side, and a base portion having a second cavity arranged to receive a magazine to be loaded, the first cavity having a first opening for entry of ammunition into the first cavity and a second opening for exit of ammunition from the first cavity to the second cavity. Also, GB 2487801 provides a plurality of indentations adapted to aid gripping of the device by a user's hand. GB 2487801, however, is clearly directed to a magazine loading device for loading a plurality of rounds of ammunition into a magazine that is removed from the rifle body.

U.S. Pat. No. 447,577 discloses a cartridge feed case of magazine guns. The cartridge holders or cases of U.S. Pat. No. 447,577 are adapted to contain a number of cartridges for use with that class of magazine guns in which the cartridges are supplied to the magazine from the top or from the bottom or from one or the other side, and more especially to that class of magazine-guns in which the magazine depends from the receiver, and in which the cartridges are introduced into said magazine through the receiver. U.S. Pat. No. 447,577, however, does not contain a portion that allows the magazine loader to sit directly upon the lower receiver of the rifle body, or to slide over the portion of the fixed magazine that protrudes from the lower receiver of the rifle body.

U.S. Pat. No. 578,931 discloses a temporary cartridge-holder having a transversely-arranged finger-passage extending nearly to its open inner edge or bottom to permit the expulsion of the last cartridge by the fingers alone, the holder being made elastic for the normal retention of the cartridges. However, U.S. Pat. No. 578,931 does not contain a portion that allows the magazine loader to sit directly upon the lower receiver of the rifle body, or to slide over the portion of the fixed magazine that protrudes from the lower receiver of the rifle body.

U.S. Pat. No. 600,367 discloses sheet-metal cartridge-packets having a single side wall, a bullet-hold, and a head-hold, the rear portion of the side wall being formed with a wide vertically-arranged expulsion-passage entering the rear portion from its upper edge and with an extractor-opening entering the rear portion from its lower edge and located below the lower end of the expulsion passage, from which it is separated by a rearwardly-extending horizontal tie, which constitutes the sole support of the head-hold. However, U.S. Pat. No. 600,367 does not contain a portion that allows the magazine loader to sit directly upon the lower receiver of the rifle body, or to slide over the portion of the fixed magazine that protrudes from the lower receiver of the rifle body.

U.S. Pat. No. 2,783,570 discloses magazine chargers for loading a plurality of cartridges into a magazine while being assembled to a firearm. As seen in FIG. 4 of U.S. Pat. No. 2,783,570, the disclosed magazine chargers do not contain a portion that allows the magazine charger to sit directly upon the lower receiver of the rifle body, or slide over the portion of the fixed magazine that protrudes from the lower receiver of the rifle body. Instead, the disclosed magazine chargers utilize integral, restraining tabs 31 which extend inwardly and downwardly to press resiliently against the bottom one of the cartridges 14 in the magazine charger 17 and thereby releasably restrain the cartridges in such magazine charger.

U.S. Pat. No. 2,856,720 discloses a charger for easily loading a magazine while being assembled to a firearm whereby the magazine need not be removed for loading or replaced when the supply of cartridges therein is depleted. The figures of U.S. Pat. No. 2,856,720 show a firearm having a receiver 12 with a bolt 13 slidingly mounted therein and a cartridge magazine 14 separably mounted thereto, wherein the magazine 14 is of a conventional two-column type and is loaded by the insertion of a plurality of cartridges 16 into the top end thereof against a spring-loaded follower 18. The disclosed magazine chargers, however, do not contain a portion that allows the magazine charger to sit directly upon the lower receiver of the rifle body, or slide over the portion of the fixed magazine that protrudes from the lower receiver of the rifle body.

U.S. Pat. No. 2,887,811 improves the loading of box magazines from U.S. Pat. No. 2,783,570 and U.S. Pat. No. 2,856,720. U.S. Pat. No. 2,887,811 provides a pull-type clip, loaded with one or more columns of cartridges, that is inserted into the open end of the magazine until the topmost cartridge or cartridges, depending on the number of cartridge columns in the pull-type clip, is or are held within the magazine by resilient retaining means. The pull-type clip is then simply pulled from the magazine, stripping the cartridges from the clip and leaving them in the magazine due to the fact that the cartridges are held by the retaining means. The pull-type clip of U.S. Pat. No. 2,887,811 does not have the ability to allow the pull-type clip to sit directly upon the lower receiver of the rifle body, or slide over the portion of the fixed magazine that protrudes from the lower receiver of the rifle body.

U.S. Pat. No. 4,538,371 discloses a magazine loader for rapidly and easily loading cartridges into a firearm magazine, wherein the magazine loader comprises a skirt and a cartridge neck holder and a cartridge base holder attached to the skirt. The skirt has an open top through which cartridges pass. It also has an open bottom adapted to receive the magazine to be loaded. The cartridge neck holder is attached to the top of the skirt at its front end. The cartridge neck holder comprises an upwardly extending front support having two laterally extending neck arms attached to the front support at their forward ends. The laterally extending neck arms are adapted to slidably hold the neck of a cartridge. The cartridge base holder which is attached to the top of the skirt at its back end comprises an upwardly extending rear support and two laterally extending base arms. The base arms are attached to the rear support at their rearward ends. The laterally extending base arms are adapted to slidably hold the base of the cartridge. The base holder is adapted to receive cartridges held by a retainer strip, portions of which extend into the extractor recess of the cartridges. The magazine loader of U.S. Pat. No. 4,538,371, however, does not have the ability to slide over the portion of the fixed magazine that protrudes from the lower receiver of the rifle body and sit directly upon the lower receiver of the rifle body because the open bottom adapted will interfere with the raised portions of the lower receiver of the rifle body. Such interference results in the magazine loader sitting in such a position that the magazine holder cannot easily slide onto the exposed portion of the magazine that is fixed to the bottom portion of the rifle body.

U.S. Pat. No. 6,286,243 discloses a device for loading cartridges into a magazine including a body with a U-shaped cross section adapted to slide up and down upon the exterior of a magazine. The device for loading cartridges of U.S. Pat. No. 6,286,243 provides "hands-free" cartridge loading after a cartridge is positioned within a magazine's mouth rather than allowing the loader to slide onto the exposed portion of the magazine that is fixed on the bottom portion of the rifle body.

U.S. Pat. No. 6,754,987 discloses a magazine loader that includes a loading holder and an ammunition pusher. The magazine loader is configured such that the discharging opening end of the loading holder is capable of being detachably mounted on an opening of a magazine. The magazine loader of U.S. Pat. No. 6,754,987, however, does not have the ability to slide over the portion of the fixed magazine that protrudes from the lower receiver of the rifle body and sit directly upon the lower receiver of the rifle body because the open bottom will interfere with the raised portions of the lower receiver of the rifle body. Such interference results in the magazine loader sitting in such a position that the magazine holder cannot easily slide onto the exposed portion of the magazine that is fixed to the bottom portion of the rifle body.

U.S. Pat. No. 9,273,917 discloses a magazine loader that includes a loader housing having a housing interior; a slot in the loader housing, the slot communicating with the housing interior; a clip slot in the loader housing opposite the slot, the clip slot communicating with the housing interior; and a loading plunger carried by the loader housing and extending into the housing interior, the loading plunger positional between an extended preloading position and a retracted loading position in the housing interior. The magazine loader of U.S. Pat. No. 9,273,917, however, does not have the ability to slide over the portion of the fixed magazine that protrudes from the lower receiver of the rifle body and sit directly upon the lower receiver of the rifle body because the open bottom will interfere with the raised portions of the lower receiver of the rifle body. Such interference results in the magazine loader sitting in such a position that the magazine loader cannot easily slide onto the exposed portion of the magazine that is fixed to the bottom portion of the rifle body.

U.S. Pat. No. 9,239,198 discloses a magazine loader that includes a base member configured for positioning on an open end of the magazine, a first cartridge support member extending from the base member, and a second cartridge support member extending from the base member. The first cartridge support member may include a first slot configured for receiving a base end of each of the cartridges. The second cartridge support member may include a second slot configured for receiving a tip end of each of the cartridges. The magazine loader of U.S. Pat. No. 9,239,198 does not have the ability to slide over the portion of the fixed magazine that protrudes from the lower receiver of the rifle body and sit directly upon the lower receiver of the rifle body because the open bottom adapted will interfere with the raised portions of the lower receiver of the rifle body. Such interference results in the magazine loader sitting in such a position that the magazine loader cannot easily slide onto the exposed portion of the magazine that is fixed to the bottom portion of the rifle body.

U.S. Patent App. No. 2013/0232843 discloses a loading device including a funneled port to facilitate the loading of cartridges into the loading device. Once a cartridge is introduced into the loading device, it is plunged into the magazine via a lever, handle, or knob incorporated on the loading device which is squeezed to activate the device, pushing the cartridge into the open end of the magazine. The loading device of U.S. Patent App. No. 2013/0232843 is clearly used on a magazine that is removed from a firearm, and thus does not address the problem solved by the instant application.

Commercially available magazine loaders, such as the THERMOLD® MC-SC-M-16/AR-15 Magazine Charger and the MAGLULA RANGE BENCHLOADER™ are similarly designed to load magazines that are detached from the rifle body. These commercially available magazine loaders do not have the ability to sit directly upon the lower receiver of a rifle body when the magazine is fixed thereto.

The above-mentioned commercially available magazine loaders and known magazine loaders do not achieve the goal of being able to load a magazine that is fixed to a semiautomatic rifle conveniently. The magazine loader of the instant application solves the problems of the known magazine loaders and allows for the convenient use with semiautomatic rifles having magazines fixed thereto in accordance with the requirements of the NYSAFE Act and similar laws.

BRIEF SUMMARY

In view of the above-mentioned exemplary problems with conventional and known magazine loaders, the inventor has provided magazine loaders and associated methods, including the following.

First, a magazine loader for loading a magazine that is fixed to a rifle, comprising a base member and support members, the base member being configured to sit upon the magazine that is fixed to a rifle, the base member having a first end wall, a second end wall, and a pair of sidewalls defining a rectangular shape, wherein the first end wall has an opening that allows the base member to sit upon the magazine that is fixed to a rifle, wherein the entirety of the second end wall and the entirety of each of the sidewalls is coplanar, wherein the support members comprise a first support member and a second support member each extending from a top surface of the base member, wherein the first support member has support lips that form a channel that is capable of accepting a retainer strip of one or more cartridges, and wherein the second support member receives a bullet end of the one or more cartridges.

The magazine loader described above, further comprising a pushing mechanism that comprises a handle and a push bar, wherein the push bar contains a plurality of guiding members and a bottom portion, wherein the bottom portion extends from the push bar in a direction of both the first support member and the second support member, wherein the first support member and the second support member are connected to form a single solid support member that has a plurality of sidewalls, a rear wall, and a front wall that together define a rectangular shape, wherein each of the plurality of sidewalls includes a groove having a shape that corresponds to a shape of one of the plurality of guiding members, and wherein the pushing mechanism slidably engages with the grooves in the plurality of sidewalls.

The magazine loader described above, further comprising a lid portion that engages with a hinge to allow the lid portion to swing away from the single solid support member and one or more locking tabs on the front wall of the single solid support member, wherein the lid portion comprises a cutout that has substantially the same shape as a cross section of the push bar, allowing the pushing mechanism to be engaged through the lid portion.

A method of loading a magazine that is fixed to a rifle comprising exposing a top of the magazine, placing the magazine loader which has been loaded with one or more cartridges onto an exposed portion of the top of the magazine, placing a downward force upon the cartridges located in the magazine loader to press the cartridges through the magazine loader and into the magazine, thereby loading the rifle having the magazine fixed thereto.

A method of loading a magazine that is fixed to a rifle comprising exposing a top of the magazine, placing the magazine loader comprising the pushing mechanism which has been loaded with one or more of cartridges onto an exposed portion of the top of the magazine, placing a downward force upon the pushing mechanism to push the cartridges located in the magazine loader through the magazine loader and into the magazine, thereby loading the rifle having the magazine fixed thereto.

DETAILED DESCRIPTION

The magazine loader and associated method will now be described by reference to the preferred embodiments. The description provided herein is not intended to limit the scope of the present claims, but to exemplify the variety encompassed by the present application. The embodiments are described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

A First Embodiment

Figure 1:
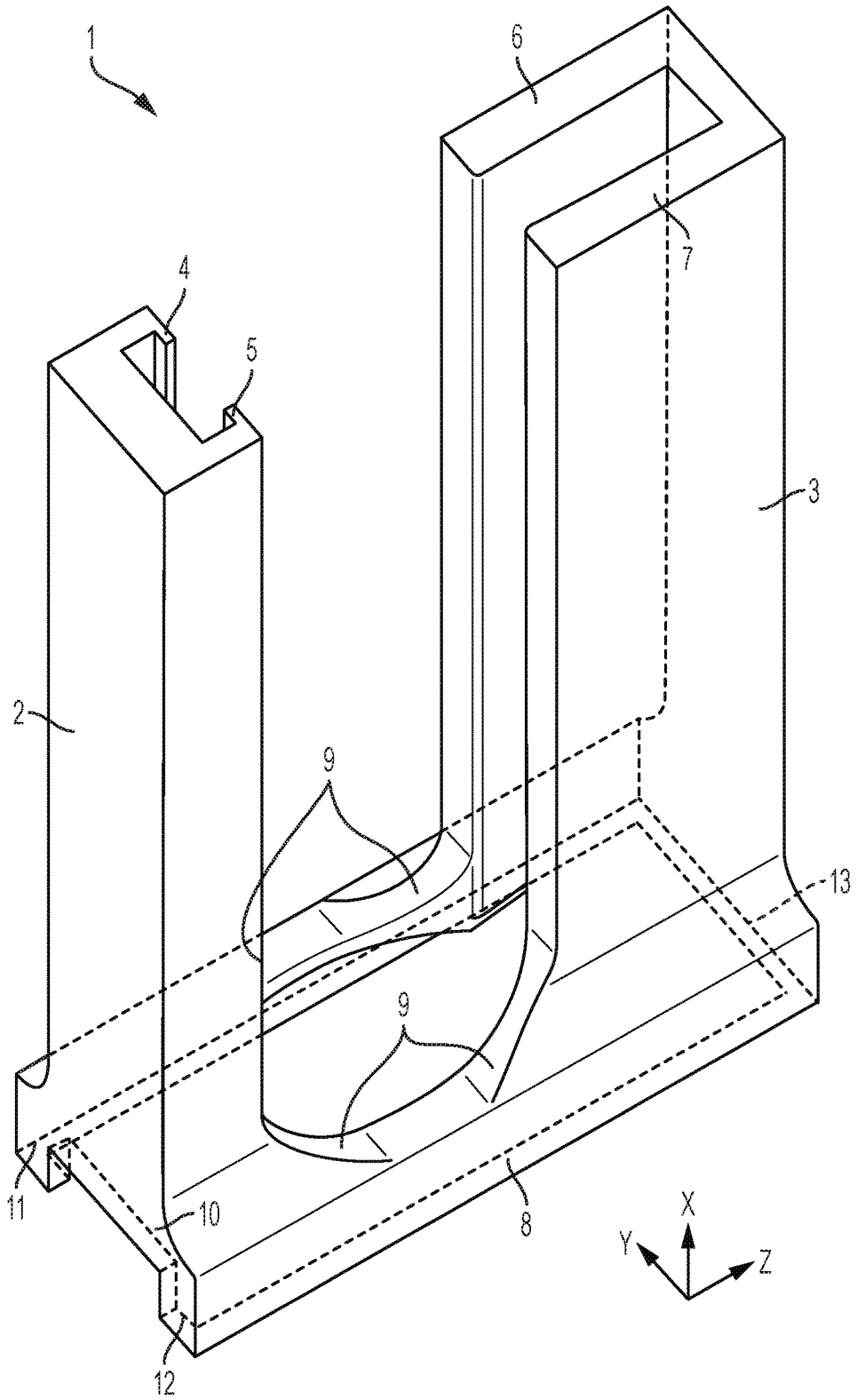
FIG. 1 provides a perspective view of an exemplary embodiment of the magazine loader described herein.

FIG. 1 illustrates a first exemplary embodiment of the magazine loader of the instant application. The magazine loader 1 can include one or more support members, such as a first support member 2 and a second support member 3 as shown in FIG. 1. The first support member 2 and the second support member 3 can be located at opposite ends of the magazine loader 1, and can optionally include a space separating the first support member 2 and the second support member 3. The optional space separating the first support member 2 from the second support member 3 allows a user to press cartridges manually through the magazine loader 1 and into a magazine that is fixed on a semiautomatic rifle. Each of the first support member 2 and the second support member 3 can have an outside portion, an inside portion, a top portion, a bottom portion, and a plurality of side portions.

The first support member 2 can include a first support lip 4 and a second support lip 5. Both the first support lip 4 and the second support lip 5 can be located on the inside portion of the first support member 2, and can extend towards the second support member 3. The first support lip 4 and the second support lip 5 can extend inwardly from the plurality of side portions, respectively. Also, the first support lip 4 and the second support lip 5 can extend from the top portion to the bottom portion of the first support member 2. The arrangement of the first support lip 4 and the second support lip 5 can be configured to create a channel to accept a retainer strip of cartridges for use in the magazine loader 1. The first support lip 4 and the second support lip 5 extend to the base portion 8 and form a plurality of shoulders. These shoulders provide a place for the retainer strip to sit when inserted into magazine loader.

The second support member 3 can include a first support portion 6 and a second support portion 7. Both the first support portion 6 and the second support portion 7 can be located on the inside portion of the second support member 3, and can extend towards the first support member 2. The first support portion 6 and the second support portion 7 can have a uniform thickness, or optionally can be configured such that the first support portion 6 and the second support portion 7 increase in thickness as the first support portion 6 and the second support portion 7 extend toward the first support member 2. Also, the first support portion 6 and the second support portion 7 can extend from the top portion to the bottom portion of the second support member 3. The arrangement of the first support portion 6 into the second support portion 7 can be configured to accept the top portion of the cartridge for use in the magazine loader 1.

The first support member 2 and the second support member 3 can extend into an upward direction from a base portion 8. The outside portions of the first support member 2 and the second support member 3 can be flush with the outside portions of the base member 8. The width of the base portion 8 can be wider than the widths of the first support member 2 and the second support member 3, respectively. Each of the first support member 2 and the second support member 3 can be connected to the base portion 8 with a plurality of inward facing curved portions 9 and a plurality of side facing curved portions 10. The base portion 8 can include a plurality of base support members, such as the first base support member 11 and a second base support member 12 in FIG. 1. The first base support member 11 and the second base support member 12 can extend in a downward direction from the base portion 8 and in a direction away from the first support member 2 and the second support member 3. Each of the first base support member 11 and the second base support member 12 can be located on the sidemost portions of the base portion 8, and can extend for the entire length of the base portion 8. The first base support member 11 and the second base support member 12 can be connected with a base connecting portion 13 that connects the first base support member 11 and the second base support member 12 on the outside portion of the base portion 8 that is below the second support member 3. Also, the first base support member 11 and the second base support member 12 can be configured to leave an open portion on the outside portion of the base portion 8 that is below the first support member 2. The open portion can allow the magazine loader 1 to accommodate a bolt catch/release mechanism of a rifle that has a magazine fixed thereto. For instance, the width of the open portion can be approximately 0.6 inches and the height of the open portion can be approximately 0.3 inches. By including the open portion, the magazine loader 1 can rest upon the lower receiver of the rifle while being used, which allows the user to load a rifle magazine that is fixed to a rifle. For instance, the magazine loader 1 can be configured for use with AR-10®/AR-15® style rifles having a magazine fixed thereto.

A Second Embodiment

Figure 2:
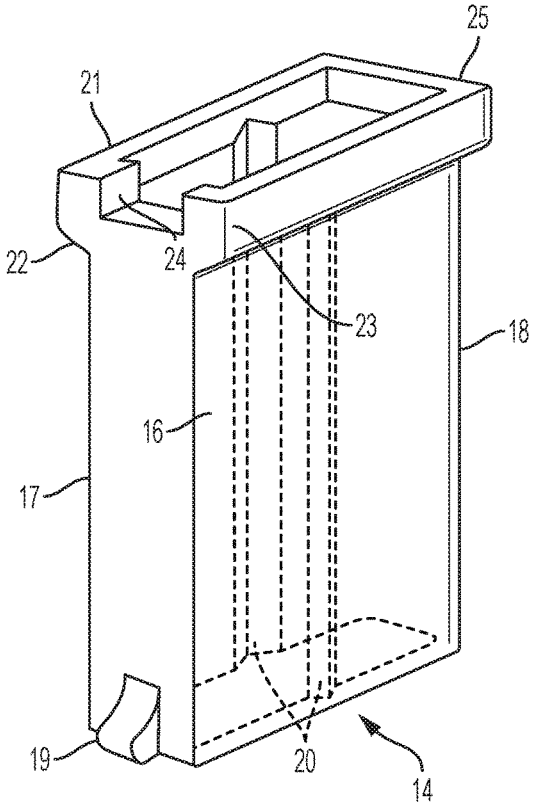
FIG. 2 provides a perspective view of an exemplary embodiment of the magazine loader described herein having a pushing mechanism.
Figure 3:
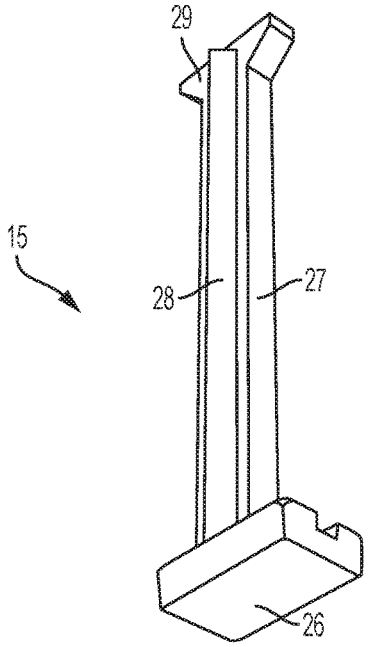
FIG. 3 provides a perspective view of a pushing mechanism.
Figure 4:
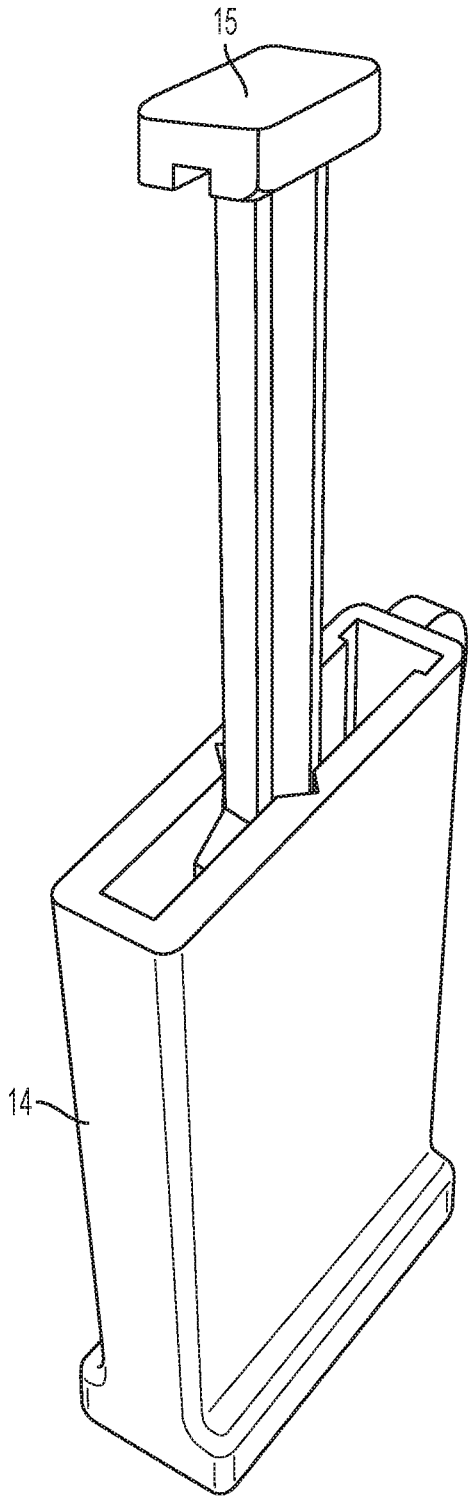
FIG. 4 provides a perspective view of an exemplary embodiment of the magazine loader described herein having a pushing mechanism engaged therewith.

FIGS. 2-4 illustrate a second exemplary embodiment of the magazine loader of the instant application. As seen in FIGS. 2-4, the second exemplary embodiment includes a magazine loading body 14 and a pushing mechanism 15.

The magazine loading body 14 is shown in FIG. 2. The magazine loading body 14 can include an upper portion having a plurality of sidewalls 16, a rear wall 17, and a front wall 18 that together form a rectangular shape. A hinge 19 can optionally extend from the rear wall 17 of the magazine loading body 14, and can be located on the uppermost portion of the rear wall 17. Each of the plurality of sidewalls 16 can include a groove 20. The groove 20 can be a semi-round shape or any shape that facilitates guidance of the pushing mechanism, such as a triangular shape or a square shape. The groove 20 can extend from the top of the corresponding sidewall 16 to the bottom of the corresponding sidewall 16.

The magazine loading body 14 can also include a base portion 21. The upper portion of the magazine loading body 14 can be attached to and extend from the base portion 21, and can include a plurality of side facing curved portions 22 that can provide additional support for the connection of the magazine loading body 14 to the base portion 21. The base portion 21 can include a plurality of base support members, such as a first base support member 23 and a second base support member 24 in FIG. 2. The first base support member 23 and the second base support member 24 extending the downward direction from the base portion 21 and in a direction away from the upper portion of the magazine loading body 14. Each of the first base support member 23 and the second base support member 24 can be located on the sidemost portions of the base portion 21, and can extend for the entire length of the base portion 21. The first base support member 23 and the second base support member 24 can be connected with a base connecting portion 25 that connects the first base support member 23 and the second base support member 24 on the outside portion of the base portion 21 that is below the front wall 18. Also, the first base support member 23 and the second base support member 24 can be configured to leave an open portion on the outside portion of the base portion 21 that is below the rear wall 17. The open portion can allow the magazine loading body 14 to accommodate a bolt catch/release mechanism of a rifle that has a magazine fixed thereto. By including the open portion, the magazine loading body 14 can rest upon the lower receiver of the rifle while being used, which allows the user to load a rifle magazine that is fixed to a rifle. For instance, the magazine loading body 14 can be configured for use upon AR-10®/AR-15® style rifles having a magazine fixed thereto. The magazine loading body 14 can also include a channel to accept a retainer strip of cartridges for use in the magazine loader 14.

The pushing mechanism 15 is shown in FIG. 3. The pushing mechanism 15 can include a handle 26 and a push bar 27. The push bar 27 can include a plurality of guiding members 28 and a bottom portion 29. The plurality of guiding members 28 can be located on the side portions of the push bar 27, and can extend for the entire length of the push bar 27. The plurality of guiding members 28 can have a semi-round shape or any other shape which would provide guidance of the push bar 27, such as a triangular or square shape. The shape of each of the plurality of guiding members 28 is arranged such that the guiding members 28 substantially corresponds with the grooves 20 in each of the plurality of sidewalls 16 in the magazine loading body 14, respectively. The bottom portion 29 can extend from the front and rear surface of the push bar 27, and can be located on the lowermost portion of the push bar 27. The width of the push bar 27 and the bottom portion 29 substantially corresponds to the distance between the inner surface of the sidewalls 16 in the magazine loading body 14 such that the pushing mechanism 15 can push cartridges through the magazine loading body 14 and into a magazine that is fixed on a rifle.

FIG. 4 provides an example of a pushing mechanism 15 engaged with the magazine loading body 14. A user of the embodiment shown in FIG. 4 could place downward pressure upon the pushing mechanism 15 to force cartridges through the magazine loading body 14 and into a magazine that is fixed on a rifle.

Figure 5:
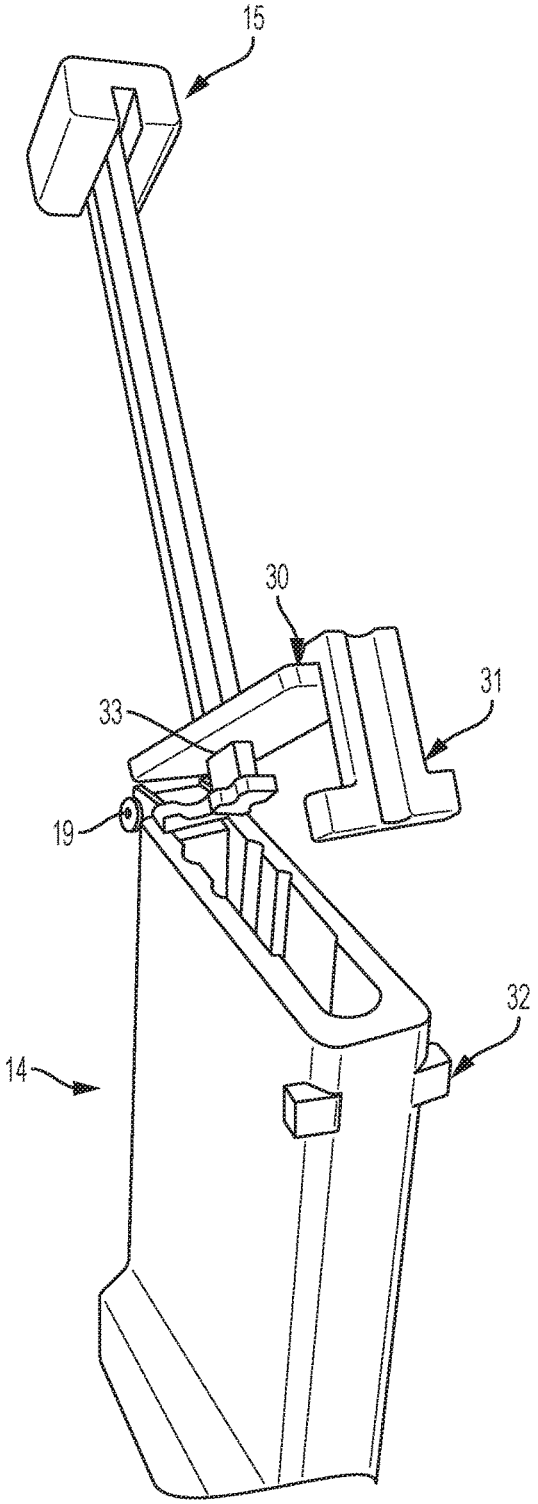
FIG. 5 provides a perspective view of an exemplary embodiment of the magazine loader described herein having a pushing mechanism engaged therewith that is attached via a lid and hinge.

In an alternative embodiment shown in FIG. 5, a lid portion 30 can be included that engages with the hinge 19 to allow the lid portion 30 to swing away from the magazine loading body 14, while remaining attached at the hinge 19. The lid portion 30 can also include a locking portion 31 that engages with locking tabs 32 optionally located on the front wall 18 of the magazine loading body 14. Further, the lid portion 30 can include a cutout 33 that has substantially the same shape as a cross section of the push bar 27, allowing the pushing mechanism 15 to be held in place by the cutout 33 in the lid portion 30. The cutout 33 in the lid portion 30 can be arranged such that the pushing mechanism 15 engages with the magazine loading body 14 when the lid portion 30 is engaged with the locking tabs 32 optionally located on the front wall 18 of the magazine loading body 14.

Method of Use

Figure 6:
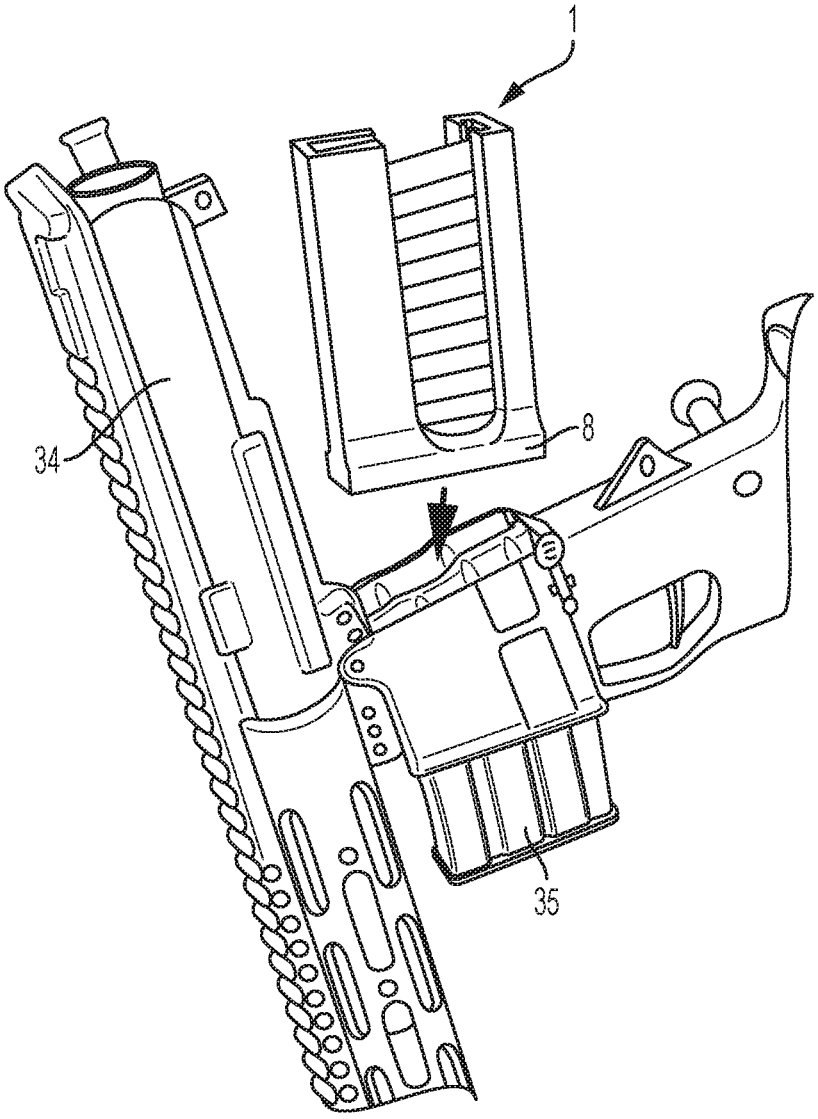
FIG. 6 provides a schematic representation of a method for loading a magazine that is fixed to a semiautomatic rifle using an embodiment of the magazine loader described herein.

FIG. 6 provides an example of a use of the magazine loader 1 to load a magazine 31 that is fixed to a rifle 34. As seen from FIG. 6, a user is not required to detach the magazine from the rifle 34 before loading the magazine 35 attached thereto. Examples of acceptable rifles include: AR-10® and AR-15® style rifles, such as those manufactured by ADAMS ARMS®, ADCOR DEFENSE™, ADVANCED ARMAMENT COMPANY™, AERO PRECISION™, ALEXANDER ARMS®, AMERICAN TACTICAL IMPORTS™, ANDERSON RIFLES™, ARES ARMS™, ARMALITE®, BRAVO COMPANY USA™, BLACK RAIN ORDNANCE®, BUSHMASTER®, CMMG®, COLT®, DANIEL DEFENSE®, DEL-TON®, DPMS®, DRD TACTICAL®, FULTON ARMORY™, GA PRECISION®, KAK INDUSTRIES™, KNIGHTS ARMAMENT®, LARUE TACTICAL®, LEWIS MACHINE AND TOOL™, LWRC®, MEGA ARMS™, PALMETTO STATE ARMORY®, PATRIOT ORDNANCE FACTORY®, REMINGTON ARMS®, ROCK RIVER ARMS®, SIG SAUER®, SOTA ARMS™, AND SPRINGFIELD ARMORY®. The aforementioned examples are not an all-inclusive list because there are at least 350 manufacturers that produce either complete rifles or parts to assemble AR-10® and AR-15® style rifles. Also, AR-10® and AR-15® style rifles are available in multiple calibers. The magazine loaders of the present application work with most cartridge sizes. Magazines typically have two lips that are present on the top of the magazine, commonly referred to as feed lips. During the action of pushing the cartridges through the loader into the magazine, the cartridges pass by the feed lips. The diameter of the cartridge should be able to be pushed past these feed lips when being loaded with the magazine loaders of the present application. Cartridges for calibers having the diameter such that the cartridge cannot be pushed past the feed lips will need to be manually loaded into the magazine rather than introduced with the magazine loaders of the present application. For example, a common caliber for the AR-15® platform is the .223 REMINGTON®. The normal action for loading a magazine is to push the cartridge in between the feed lips, which is repeated until the magazine reaches its capacity. Another caliber that is used in the AR-15® platform is the .458 SOCOM®. The .458 SOCOM® cartridge is larger than the feed lips and cannot be loaded by pushing the cartridge past the feed lips. These cartridges, inter alia, that are too large to push past the magazine feed lips require manual loading into the magazine. The cartridge base, commonly known as the end with the primer, is inserted from the end of the magazine, which does not have the feed lips, by pushing down the magazine follower while sliding under the feed lips for retention in the magazine.

The method will be described in further detail as follows. First, the user can obtain a rifle 34 having a magazine 35 fixed thereto. Second, the user can pivot an upper portion of the rifle 34 to expose the top of the magazine 35, which can extend slightly above the upper surface of the lower portion of the rifle 34. Third, the user can load a number of cartridges into the magazine loader 1, wherein the number of cartridges does not exceed the capacity of the magazine 35. Fourth, the user can place the magazine loader 1 having been loaded with a number of cartridges onto the exposed portion of the top of the magazine 35. The open portion of the base portion 8 can allow the magazine loader 1 to accommodate a bolt catch/release mechanism of the rifle 34 such that the magazine loader 1 can rest upon the upper surface of the lower portion of the rifle 34. Fifth, the user can place a downward force upon the cartridges located in the magazine loader 1 to press the cartridges through the magazine loader 1 and into the magazine 34 thereby loading the rifle 34 having a magazine 35 fixed thereto.

Alternatively, the user could load the rifle 34 having a magazine 35 fixed thereto according to the second exemplary embodiment described in detail above.

Each of the magazine loaders of the present application can be made from a number of materials. For instance, the magazine loaders of the present application can be made from plastics, such as polyester (PES), polyethylene terephthalate (PET), polyethylene (PE), chlorinated polyethylene (CPE), high-density polyethylene (HDPE), polyvinyl chloride (PVC), polyvinylidene chloride (PVDC), low-density polyethylene (LDPE), polypropylene (PP), polystyrene (PS), high impact polystyrene (HIPS), polyamides (PA) (i.e., nylons), acrylonitrile butadiene styrene (ABS), polycarbonate (PC), polycarbonate/acrylonitrile butadiene styrene (PC/ABS), polyurethanes (PU), and the like. The magazine loaders of the present application can also be made from metals and metal alloys including, for instance, lightweight aluminum alloys. Additionally, the magazine loaders of the present application can be made with materials used in three-dimensional printing devices, such as thermoplastic powders, metal powders, ceramic powders, metal alloys, photopolymers, etc. Other materials that are acceptable include glasses, ceramics, and woods. The magazine loaders of the present application can be produced via injection molding, three-dimensional printing, metal casting, etc.

The foregoing description of the invention illustrates and describes the present invention. Additionally, the disclosure shows and describes only the preferred embodiments of the invention but, as mentioned above, it is to be understood that the invention is capable of use in various other combinations, modifications, and environments and is capable of changes or modifications within the scope of the inventive concept as expressed herein, commensurate with the above teachings and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

I claim:

1. A magazine loader for loading a magazine that is fixed to an AR-10 or AR-15 rifle having a bolt catch and release mechanism, comprising a base member and support members, the base member being configured to sit upon the magazine that is fixed to an AR-10 or AR-15 rifle having a bolt catch and release mechanism, the base member having a first end wall, a second end wall, and a pair of sidewalls defining a rectangular shape, wherein the first end wall has an opening that allows the base member to sit upon the magazine that is fixed to the AR-10 or AR-15 rifle such that the bolt catch and release mechanism does not interfere with the base member sitting upon the magazine, wherein an entirety of the second end wall, and an entirety of each of the sidewalls are coplanar, wherein the support members comprise a first support member and a second support member each extending from a top surface of the base member, wherein the first support member has support lips that form a channel that is capable of accepting a retainer strip of one or more cartridges, and wherein the second support member receives a bullet end of the one or more cartridges.

2. A magazine loader for loading a magazine that is fixed to an AR-10 or AR-15 rifle having a bolt catch and release mechanism, the magazine loader comprising a base member, a support member, and a pushing mechanism, the pushing mechanism comprising a handle and a push bar, wherein the base member is configured to sit upon the magazine that is fixed to an AR-10 or AR-15 rifle having a bolt catch and release mechanism, the base member having a first end wall, a second end wall, and a pair of sidewalls defining a rectangular shape, wherein the first end wall has an opening that allows the base member to sit upon the magazine that is fixed to the AR-10 or AR-15 rifle such that the bolt catch and release mechanism does not interfere with the base member sitting upon the magazine, wherein an entirety of the second end wall, and an entirety of each of the sidewalls are coplanar, wherein the support member extends from a top surface of the base member and has a plurality of sidewalls, a rear wall, and a front wall that together define a rectangular shape, wherein the support member has support lips that form a channel that is capable of accepting a retainer strip of one or more cartridges and is capable of receiving a bullet end of the one or more cartridges opposite to the support lips, wherein the push bar contains a plurality of guiding members and a bottom portion, wherein the bottom portion extends from the push bar in a direction of both the support member, wherein each of the plurality of sidewalls includes a groove having a shape that corresponds to a shape of one of the plurality of guiding members, and wherein the pushing mechanism slidably engages with the grooves in the plurality of sidewalls.

3. The magazine loader of claim 2, further comprising a lid portion that engages with a hinge to allow the lid portion to swing away from the support member and one or more locking tabs on the front wall of the support member, wherein the lid portion comprises a cutout that has substantially the same shape as a cross section of the push bar, allowing the pushing mechanism to be engaged through the lid portion.

4. The magazine loader of claim 1, wherein the magazine loader is plastic.

5. The magazine loader of claim 2, wherein the magazine loader is plastic.

6. The magazine loader of claim 3, wherein the magazine loader is plastic.

7. A method of loading a magazine that is fixed to an AR-10 or AR-15 rifle having a bolt catch and release mechanism comprising exposing a top of the magazine, placing the magazine loader of claim 1 which has been loaded with one or more cartridges onto an exposed portion of the top of the magazine such that the bolt catch and release mechanism does not interfere with the magazine loader sitting upon the magazine, placing a downward force upon the cartridges located in the magazine loader to press the cartridges through the magazine loader and into the magazine, thereby loading the rifle having the magazine fixed thereto.

8. A method of loading a magazine that is fixed to an AR-10 or AR-15 rifle having a bolt catch and release mechanism comprising exposing a top of the magazine, placing the magazine loader of claim 2 which has been loaded with one or more cartridges onto an exposed portion of the top of the magazine such that the bolt catch and release mechanism does not interfere with the magazine loader sitting upon the magazine, placing a downward force upon the pushing mechanism to push the cartridges located in the magazine loader through the magazine loader and into the magazine, thereby loading the rifle having the magazine fixed thereto.

9. A method of loading a magazine that is fixed to an AR-10 or AR-15 rifle having a bolt catch and release mechanism comprising exposing a top of the magazine, placing the magazine loader of claim 3 which has been loaded with one or more cartridges onto an exposed portion of the top of the magazine such that the bolt catch and release mechanism does not interfere with the magazine loader sitting upon the magazine, placing a downward force upon the pushing mechanism to push the cartridges located in the magazine loader through the magazine loader and into the magazine, thereby loading the rifle having the magazine fixed thereto.

* * * * *